US008065779B2

(12) United States Patent
Kuchas

(10) Patent No.: US 8,065,779 B2
(45) Date of Patent: Nov. 29, 2011

(54) AUTOMATIC DOOR CLOSURE FOR BREAKOUT SLIDING DOORS AND PATIO DOORS

(76) Inventor: Michael Kuchas, Granville, MA (US)

( * ) Notice: Subject to any disclaimer, the term of this patent is extended or adjusted under 35 U.S.C. 154(b) by 255 days.

(21) Appl. No.: 12/221,262

(22) Filed: Aug. 1, 2008

(65) Prior Publication Data

US 2010/0024160 A1 Feb. 4, 2010

(51) Int. Cl.
*E05F 1/00* (2006.01)

(52) U.S. Cl. ..... 16/81

(58) Field of Classification Search ..... 16/81, 85, 16/209, 71, 219, 400; 49/404, 405, 447; 160/90, 96, 371; 187/333, 347
See application file for complete search history.

(56) References Cited

U.S. PATENT DOCUMENTS 617,159 A * 1/1899 Hogan et al. ..... 16/81
3,334,444 A * 8/1967 Hargrove ..... 49/404
4,003,102 A * 1/1977 Hawks et al. ..... 16/72
4,649,598 A * 3/1987 Kinsey et al. ..... 16/81
4,884,369 A * 12/1989 Tatham ..... 49/404
4,891,911 A * 1/1990 Yung ..... 49/404
5,285,596 A * 2/1994 Kinsey ..... 49/404
5,579,607 A * 12/1996 Braid ..... 49/404

FOREIGN PATENT DOCUMENTS

AU 9940143 A * 2/2000
DE 19513742 A1 * 10/1996

* cited by examiner

*Primary Examiner* — Chuck Y. Mah
(74) *Attorney, Agent, or Firm* — Robert L. Rispoli

(57) ABSTRACT

A sliding door automatic closing device is provided whereby a cylindrical tube is attached to the sliding door and a pulley housing is rotateably mounted to the top of the cylindrical tube. A cable is attached at one end to a cable housing, the housing mounted onto the frame header, and the cable is attached at a second end to a weight within the cylindrical tube. The bearing-mounted pulley housing allows the sliding door panel to breakout when needed and then be returned to its original position for continual use of the automatic closing feature without any mechanical adjustments. The bearing-mounted pulley housing, cable, and cable housing all remain in their original planar positions relative to the sliding door panel header; that is, these components do not breakout along with the sliding door panel.

7 Claims, 4 Drawing Sheets

BREAK OUT SLIDING DOOR AUTO CLOSER ASSEMBLY - FIG. 1

BROKEN OUT VIEW - FIG. 2

TOP VIEW

DETAIL G
SCALE 1 : 1
DETAIL I
SCALE 1 : 2
DETAIL H
SECTION D-D
SCALE 1 : 15

SECTION J-J
SCALE 2 : 1

VALVE ASSEMBLY

AUTOMATIC DOOR CLOSURE FOR BREAKOUT SLIDING DOORS AND PATIO DOORS

FIELD OF THE INVENTION

The present invention comprises an automatic door-closing device for use on breakout sliding doors and patio sliding doors. In particular, a device according to the present invention will automatically close a set of sliding doors whereby a first door is intended to slide over, and proximate to, a second door. The device also handles a set of sliding doors that fully break out into an open position whereby the first sliding door is placed into an open position by sliding over, and proximate to, a second door, and then the set of both doors is opened with respect to a door frame.

BACKGROUND OF THE INVENTION

1. Brief Description of the Related Art

Various prior art door-closing systems have been disclosed that self-close patio sliding doors with bottom tracks. Typically, these prior art devices utilize cylindrical tubes having a weight that is connected to a cable, the cable passes over a pulley, and the pulley is anchored in the doorjamb. Each of these door-closing systems utilizes a valve means at the bottom of the tube to control the flow of air passing therethrough.

Typical prior art sliding door closers are disclosed in U.S. Pat. No. 3,334,444 to Hargrove (hereinafter, "the '444 Patent"), and U.S. Pat. No. 4,884,369 to Tatham (hereinafter, "the '369 Patent"). As with typical prior art devices, the '444 Patent and the '369 Patent teach that when a door is opened, a weight rises in the tube; when the door is released, the weight drops in the tube according to the port adjustment in the tube, and the door closes. (See the '444 Patent, Column 5, Lines 54-61; and the '369 Patent, Abstract).

Another prior art device, U.S. Pat. No. 4,649,598 to Kinsey, et al. (hereinafter, "the '598 Patent"), utilizes a weight and pulley system such as that described above with respect to the '369 Patent, together with a pneumatic seal located at the top of the weight and designed to buffer the speed at which the door closes. (See the '598 Patent, Column 3, Lines 47-56).

However, none of the prior art devices provide an automatic door-closure mechanism for a set of sliding doors that permit the sliding doors to fully break out into an open position whereby the first sliding door is placed into an open position by sliding over, and proximate to, a second door, and the set of both doors is opened with respect to a door frame.

As an example, there remains a need within hospitals that utilize trackless breakout sliding doors in Intensive Care Units (ICU). These doors allow ICU rooms to maintain a negative pressure which is required because the hospitals are utilizing these rooms as isolation units for persons with a contagious disease. One way to have these rooms pressurized is to have the doors closed all of the time. In recent years, the demand for the automatic self-closing device has become more prevalent.

In other situations such as clean rooms, there also is a need for this self-closing device to inhibit the entry of dust and other particles into the clean room. It is has been found that clean rooms also can be negative pressure rooms. Alternatively, automatic self-closing doors might be desirable to keep particles or odors inside a room such as in laboratories where there is chemical testing, mixing, and any odors that are unwanted in other areas of the facility.

An automatic self-closing device also provides an appropriate fire door protection where typical trackless sliding doors may be used. When the smoke detectors and alarms go off, a magnet will disengage and the door closure device will automatically close the door panel to cut down on drafts from one area.

With hotels, homes, and office buildings, there is a need for a more efficient closing device for the sliding door. An improved automatic closing device for sliding doors will improve energy efficiency, convenience, security, and safety. Any improvement in self-closing doors known in the prior art will therefore be an improvement in these areas as well.

Based on the shortcomings of the prior art described above and other known prior art, the object of this present invention is to provide an automatic closing device for both the trackless breakout sliding door and the patio sliding door. Another object of the present invention is to provide additional unique features for an automatic closing device including a novel pulley housing, alternative cable fabrication material, alternative means for attaching the cable to the trackless breakout sliding door, alternative pulley housing fabrication material and alternative weighted piston fabrication material.

2. Description of the Invention

The present invention comprises an automatic door-closing device used on trackless breakout sliding doors typically installed in hospitals for ICU doors, clean room facilities, fire doors, and laboratories. This automatic door-closing device also can be used on patio sliding doors for energy efficiency, convenience, security, and safety of having a patio sliding door automatically closed.

DETAILED DESCRIPTION OF THE INVENTION

Figure 1:
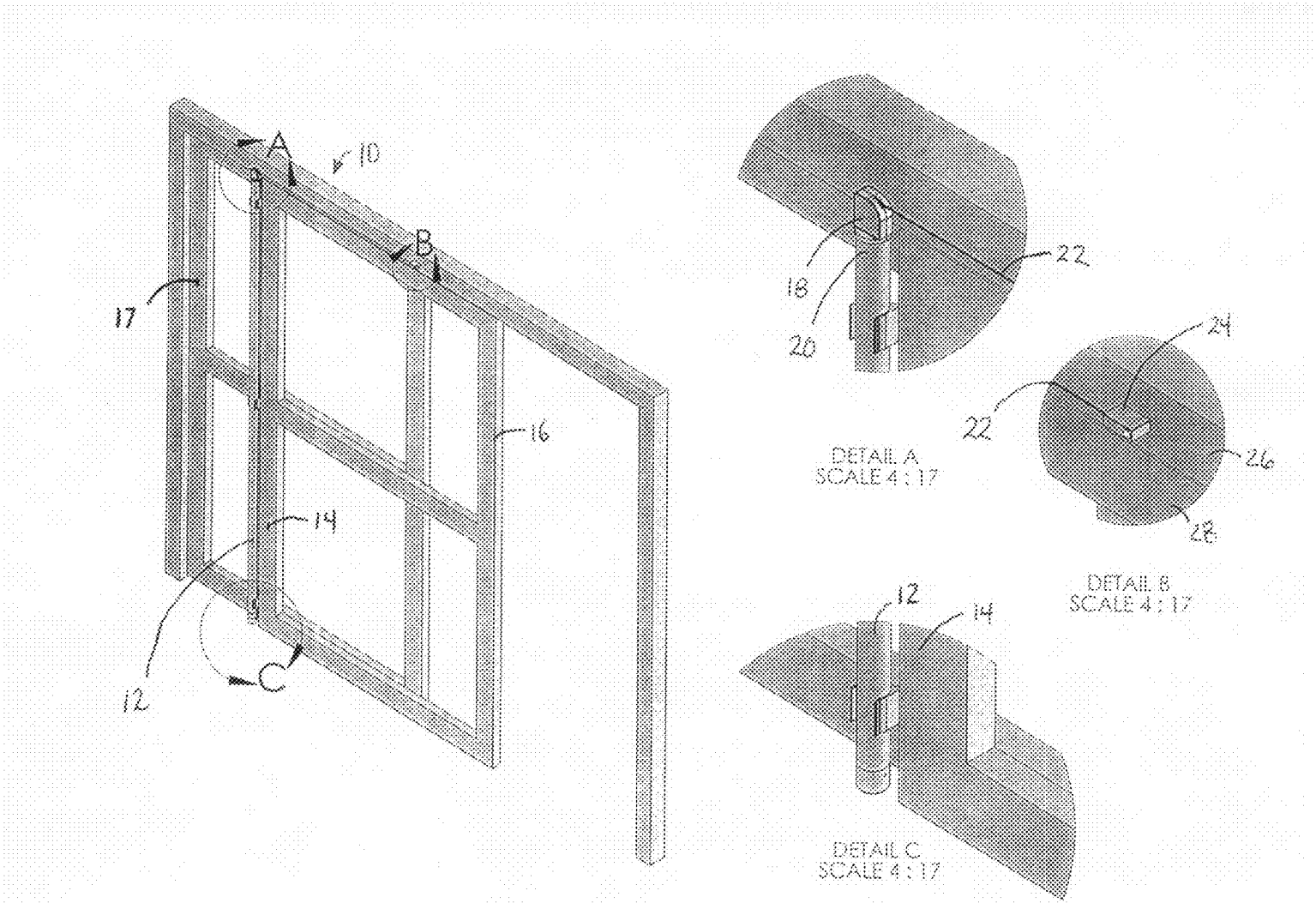
FIG. 1 provides an isometric drawing of an automatic door closure assembly according to the present invention, together with three detail views.

A door closing device system 10 according to the present invention is shown in FIG. 1. As shown in FIG. 1 and Detail C, the closing device system 10 comprises a cylindrical tube 12 attached to the front face 14 of the sliding door panel 16. Accordingly, cylindrical tube 12 may comprise a true cylindrical shape rather than define a flat portion for mating with the side width face of sliding door panel 16. As such, sliding door panel 16, together with the mounted cylindrical tube 12, may be positioned into a fully open position whereby sliding door panel 16 is placed into an open position by sliding over, and proximate to, a second door panel 17, and then the set of both doors is opened with respect to a door frame.

As shown in Detail A, a bearing-mounted pulley housing 18 is mounted on to the top portion 20 of cylinder 12. As shown in Detail B, cable 22 is anchored into cable anchor housing 24. Cable anchor housing 24 is mounted on the top face 26 of the sliding door panel header 28 (not on the sliding door 16) and substantially flush with the front face of header 28. Cable 22 can be anchored within cable anchor housing 24 by any number of known means.

Figure 2:
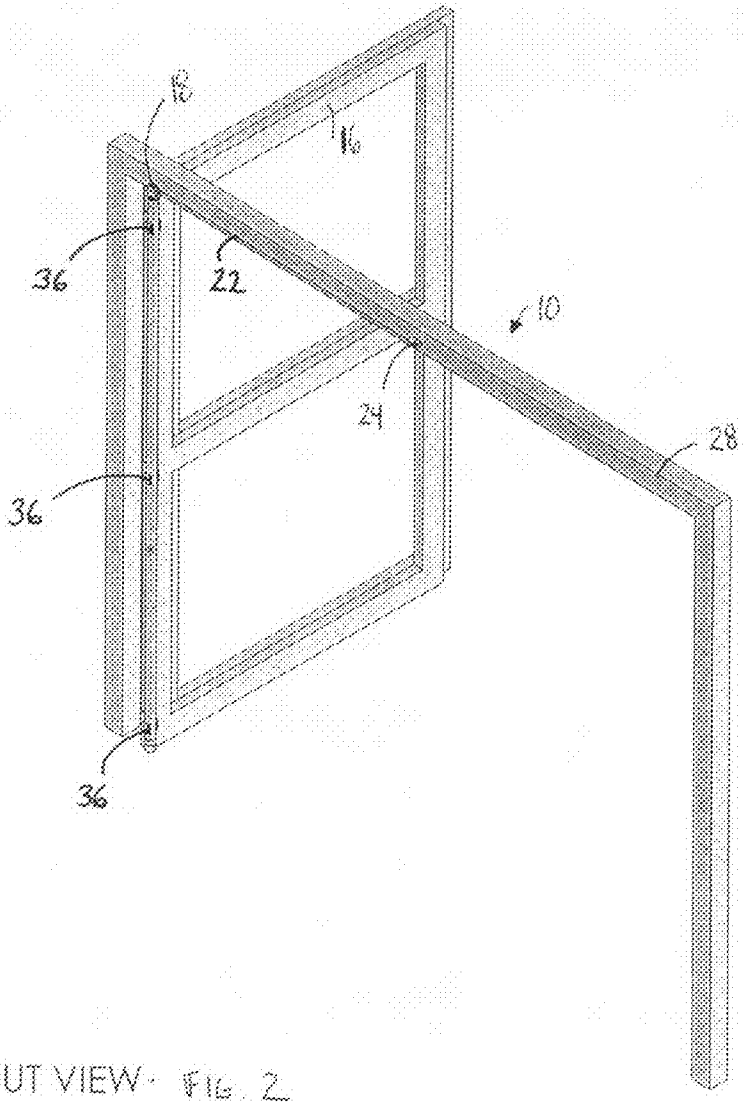
FIG. 2 provides an isometric drawing of the automatic door closure assembly shown in FIG. 1 wherein the sliding doors are shown in the breakout position.

As shown in FIG. 2, the novel bearing-mounted pulley housing 18 allows the sliding door panel 16 to breakout when needed and then be returned to its original position for continual use of the automatic closing feature without any mechanical adjustments. Note, as shown in FIG. 3, the bearing-mounted pulley housing 18, cable 22, and cable anchor housing 24 all remain in their original planar positions relative to sliding door panel header 28; that is, these components do not breakout along with sliding door panel 16.

Figures 3, 3A:
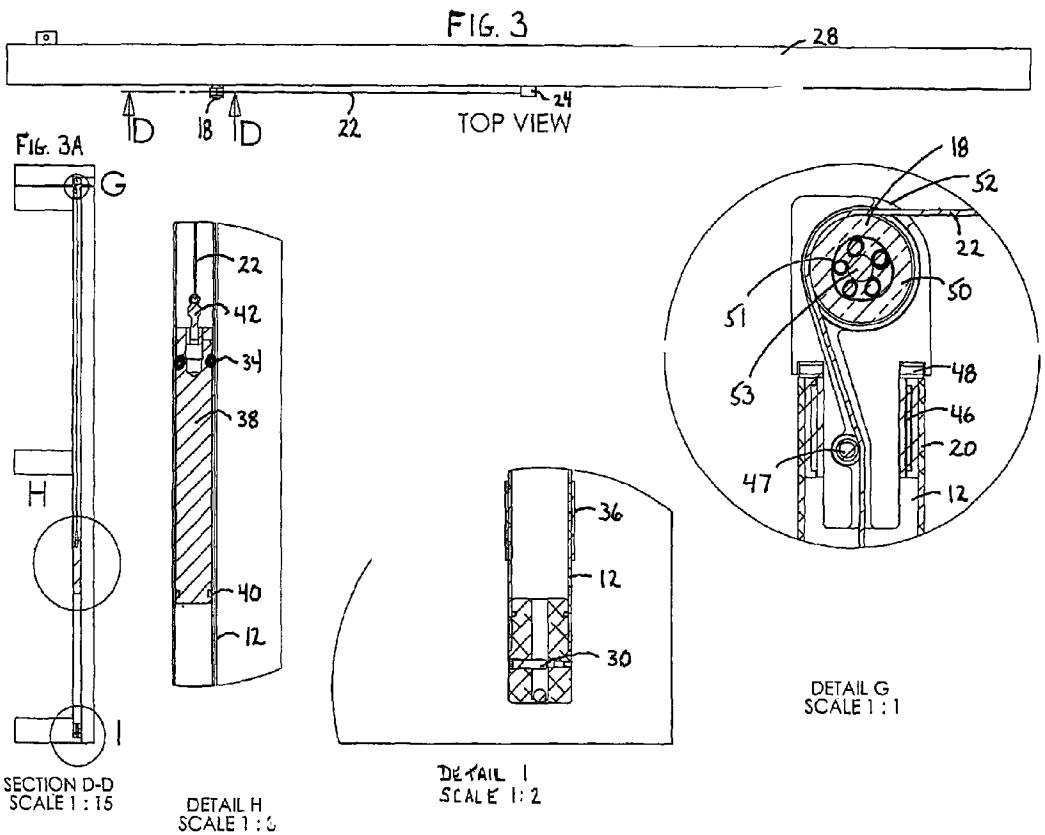
FIG. 3 provides a top-view of the automatic door closure assembly shown in FIG. 1.
FIG. 3A provides a sectional view of the automatic door closure assembly shown in FIG. 3 taken along line D-D of FIG. 3, together with three detail views.
Figure 4A:
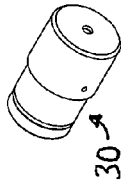
FIG. 4A provides an isometric view of a valve assembly utilized within the automatic door closure assembly shown in FIG. 1.
Figure 4B:
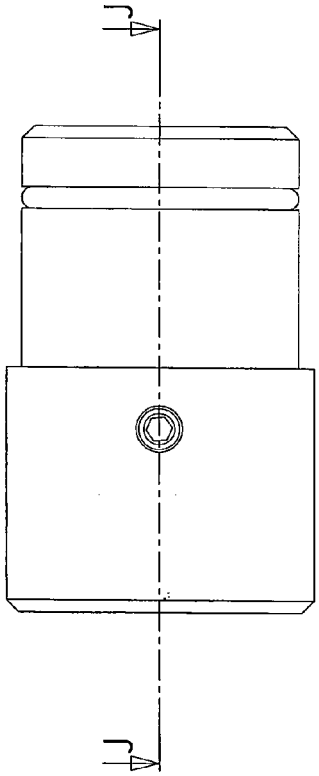
FIG. 4B provides a side view of the valve assembly shown in FIG. 4A.

As depicted in FIG. 3A, Detail I, cylinder 12 further comprises a valve assembly 30 positioned on the bottom of the cylinder 12. Valve assembly 30 is shown in greater detail in FIG. 4A, FIG. 4B and FIG. 4C. Valve assembly 30 further comprises an O-ring 34A that engages with a corresponding circular groove machined in valve assembly 30. Thus, valve assembly 30 may sealingly engage cylinder 12. The bleeder value 32 at the bottom of the valve assembly 30 controls the amount of the air coming out of the cylinder 12 which, in turn, adjusts to accommodate or limit the speed of the closing door 16. The valve can be adjusted so that the door can close faster or slower depending on the facility or resident needs.

Figure 4C:
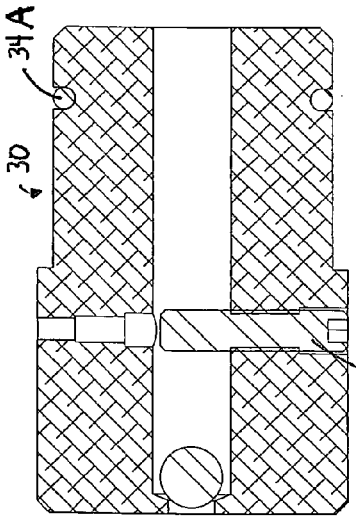
FIG. 4C provides a sectional view of the valve assembly shown in FIG. 4B taken along line J-J of FIG. 4B.

Other features shown in FIG. 3A, Detail I and FIG. 4C include cylinder 12, valve assembly 30, bleeder valve 32, O-ring 34A and bracket 36. Bracket 36 is also shown in 3 places in FIG. 2. At the top of the weight as shown in FIG. 3, Detail H, another rubber O-ring 34 engages with a corresponding circular groove machined in valve assembly 30. Thus, valve assembly 30 may sealingly engage cylinder 12. O-ring 34 dampens any piston slap against the cylinder sidewall to quite any vibration noise. In addition, as shown in FIG. 3A, Detail H, O-ring 34 guides weight 38 straight inside cylinder 12. As described hereinabove, cylinder 12 is fastened to sliding door panel 16 with bracket 36.

As further shown in FIG. 3A, Detail H, weight 38 travels vertically within cylinder 12 to accommodate the movement of sliding door panel 16. A rubber U cup 40 seals weight 38 to the inside of cylinder 12. The ball check valve within valve assembly 30 floats up, or permits air to enter cylinder 12, as weight 38 is rising and sliding door panel 16 is opening. Conversely, the configuration of valve assembly 30 permits air to exit cylinder 12 as weight 38 is descending and sliding door panel 16 is closing. When sliding door panel 16 is manually opened, weight 38 is pulled upward by cable 22 attached to the weight 38 on one end and cable anchor housing 24 on the other end. As sliding door panel 16 starts to close, gravity takes over which causes weight 38 to descend thereby pulling sliding door panel 16 completely closed.

A rubber U-cup 40 is mounted at the bottom of weight 38. U-cup 40 flairs out when weight 38 is rising and keeps weight 38 sealed to the inside of cylinder 12. Conversely, as weight 38 is dropping, pneumatic seal U-cup 40 compresses air down through the valve assembly 30 to seal off the weight to the inside of the cylinder below the weight. The air is regulated through a check valve set screw that may be turned in and out to let more air out or less air out which controls the speed of the door.

Cable 22 may be attached to weight 38 by any one of a number of known means. In the embodiment taught herein and shown in FIG. 3A Detail H, cable 22 is attached to weight 38 by use of a counter-sunk threaded adapter 42 anchoring cable 22 to weight 38. Cable 22 is attached to threaded adapter 42 with a swivel connection so that there is no twisting of the cable if weight 38 started twisting inside cylinder 12. O-ring 34 provides for noise and vibration dampening.

As described hereinabove and shown in FIG. 3A Detail G, bearing-mounted pulley housing 18 is mounted on to the top portion 20 of cylinder 12. Note that cylinder 12 actually rotates in relation to bearing-mounted pulley housing 18 when sliding door panel 16 is in the breakout position. As shown more clearly in FIG. 2, the entire cable mechanism does not rotate in relation to cylinder 12 when sliding door panel 16 is in the breakout position. Cable 22 is anchored into cable anchor housing 24, which, in turn, is mounted on the top face 26 of the sliding door panel header 28. The header 28 remains in place and, therefore, so must the hardware mounted thereto. Of particularly novel design in the embodiment of the present invention is that breakout of sliding door panel 16 is permitted while still maintaining the automatic feature of door closing device system 10.

Bearing-mounted pulley housing 18 has been designed for the trackless breakout sliding doors because these doors also hinge. In addition, this design also can be used with a regular sliding patio door to accommodate proper alignment with the anchoring point of the cable. Bearing-mounted pulley housing 18 rotates in relation to cylinder 12 when the door breaks out or is in a hinging position. This new design contains a vertical needle bearing 46 that is inserted into cylinder 12. Bearing-mounted pulley housing 18 in turn is positioned within vertical needle bearing 46. A second pulley assembly 47 is mounted on an axle within bearing-mounted pulley housing 18 to center the cable 22 for positioning within bearing-mounted pulley housing 18.

Returning to in FIG. 3A Detail G, thrust bearing 48 is positioned at the top of cylinder 12, whereon the bearing-mounted pulley housing 18 can rest, thereby causing less friction and accommodating rotation when the door breaks out. Accordingly, thrust bearing 48 relieves vertical friction and vertical needle bearing 46 relieves horizontal friction. This design also allows the pulley housing and the cylinder to return to a properly aligned positioned when the door is put back into the sliding position without any mechanical adjustments needed. The actual pulley 50 can be any properly sized, conventional pulley known in the art. Bearing-mounted pulley housing 18 also comprises slot 52 to accommodate the running of cable 22 from weight 38 to cable anchor housing 24.

In a preferred embodiment of the invention, bearing-mounted pulley housing 18 comprises pulley 50 which, in turn, comprises a ball bearing assembly 51 rotateably mounted on mounting axle 53. This embodiment introduces far less friction into the system than any prior art device and reduces wear of all of the related components passing therethrough.

The bearing-mounted pulley housing also allows the sliding door panel to move into a breakout position without any damage to the cable. Similarly, the mechanism permits the sliding door panel to return to a properly aligned position when the door is put back into the sliding position without requiring any mechanical adjustments. When the sliding door panel is broken out of the header frame, the door is opened all the way causing the cable to stretch. With the door closing systems presently known in the art, the door could scrape the bottom edge of the cable and fray the cable. The bearing-mounted pulley housing design of this present invention eliminates that problem by actually rotating the cylindrical tube with respect to the sliding door when the door breaks out.

The bearing-mounted pulley housing design also can be used with a regular sliding patio door to accommodate the proper alignment with an anchoring point of the cable. With conventional sliding patio doors, door closer clips have to be installed to create a proper alignment with the anchoring point of the cable. This can be unsightly. The bearing-mounted pulley housing solves this problem.

One embodiment of a bearing-mounted pulley housing according to the present invention, and in further contrast to the prior art, is that the pulley housing is fabricated from aluminum rather than plastic. It is found to be efficient while allowing the cable to run true with the least amount of friction. In addition, with a unit fabricated from aluminum, there is less wear and tear on the cable because of the strength of aluminum in comparison to plastic.

Another embodiment of the present invention comprises the means for attaching the cable to the cable anchor housing. Prior art means for attaching a cable to a cable anchor housing comprise an eyelid connector for the cable. To eliminate the potential of cable connection breakage, the present invention comprises an off-set aluminum block with a through bolt to fasten the block to the door and to loop the cable around the inner shaft of the bolt. Therefore, when the cable is wrapped around the stand off and comes back out through the guide hole, it is connected with a nickel press and ties off in a slipknot. This prevents the problems found with the prior art designs by eliminating any sharp corners that could eventually break the cable.

In a preferred embodiment of the present invention, the cable used is a fiber cable rather than steel. This fiber cable has been effective under a 360-pound test. The weight used for the closing device is only about 3.5 pounds therefore there is no concern for breakage of the cable. The cable also is preferred because it is very flexible and very slippery thereby causing very little friction and creating a long life expectancy for the cable.

A preferred embodiment of the present invention comprises a weight wherein the weight in turn comprises solid steel. Other prior art devices have used a drawn aluminum; however, a solid steel weight is found to be much cleaner than the drawn aluminum weight. The drawn aluminum tube weight used by others contains lead and potentially additional lead shot if needed. That method is found to be very messy and much harder to install and/or repair. By utilizing a solid steel weight with this new self-closing device, it is found to be more successful and much cleaner to install and/or repair. For hospitals, clean room facilities, and residential usage, a cleaner more efficient weight is preferred.

The automatic door-closing device of the present invention overcomes the shortcomings of the prior art. Although the invention has been described in considerable detail with respect to particular embodiments of Applicant's automatic door-closing device, it will be apparent that the invention is capable of numerous modifications and variations, apparent to those skilled in the art, without departing from the spirit and scope of the invention.

The invention claimed is:

1. A sliding door automatic closing device comprising:
a) a sliding door frame header;
b) at least one sliding door;
c) a cylindrical tube attached to the sliding door;
d) a pulley housing rotateably mounted to the top of the cylindrical tube wherein the pulley housing is mounted within a thrust bearing and the thrust bearing is mounted to the top of the cylindrical tube;
e) a weight positioned within the cylindrical tube;
f) a cable attached at one end to the frame header and at a second end to the weight; and
g) a valve positioned at the bottom of the cylindrical tube.

2. The sliding door automatic closing device of claim 1 further comprising a cable housing mounted to the frame header wherein the cable is attached to the cable housing.

3. The sliding door automatic closing device of claim 1 wherein the pulley further comprises a ball bearing assembly.

4. A sliding door automatic closing device comprising:
a) a sliding door frame header;
b) at least one sliding door;
c) a cylindrical tube attached to the sliding door;
d) a pulley housing rotateably mounted to the top of the cylindrical tube wherein the pulley housing is mounted within a needle bearing, and the needle bearing is mounted to the top of the cylindrical tube;
e) a weight positioned within the cylindrical tube;
f) a cable attached at one end to the frame header and at a second end to the weight; and
g) a valve positioned at the bottom of the cylindrical tube.

5. The sliding door automatic closing device of claim 4 wherein the pulley further comprises a ball bearing assembly.

6. The sliding door automatic closing device of claim 4 further comprising a cable housing mounted to the frame header wherein the cable is attached to the cable housing.

7. A sliding door automatic closing device comprising:
a) a sliding door frame header;
b) at least one sliding door;
c) a cylindrical tube attached to the sliding door;
d) a means for controlling air flow into and out of the cylindrical tube;
e) a pulley housing rotateably mounted to the top of the cylindrical tube wherein the pulley housing is mounted within a thrust bearing and within a needle bearing;
f) a weight positioned within the cylindrical tube; and
g) a cable attached at one end to the frame header and at a second end to the weight.

* * * * *